US007959345B2

(12) United States Patent
Benjamin, II

(10) Patent No.: US 7,959,345 B2
(45) Date of Patent: Jun. 14, 2011

(54) SYSTEM FOR SECURING A CONTAINER WITHIN A MIXING MACHINE

(75) Inventor: Wilken Benjamin, II, Mundelein, IL (US)

(73) Assignee: Valspar Sourcing, Inc., Minneapolis, MN (US)

( * ) Notice: Subject to any disclaimer, the term of this patent is extended or adjusted under 35 U.S.C. 154(b) by 957 days.

(21) Appl. No.: 11/891,672

(22) Filed: Aug. 10, 2007

(65) Prior Publication Data

US 2009/0040865 A1 Feb. 12, 2009

(51) Int. Cl.

| | |
|---|---|
| ***B65D 90/12*** | (2006.01) |
| ***B65D 25/24*** | (2006.01) |
| ***B01F 15/00*** | (2006.01) |
| *B01F 11/00* | (2006.01) |

(52) U.S. Cl. ..... 366/110; 366/209; 366/218; 366/605; 220/628; 220/632; 220/737

(58) Field of Classification Search ..... 366/110, 366/111, 208, 218, 219, 605; 220/628, 632, 220/737

See application file for complete search history.

(56) References Cited

U.S. PATENT DOCUMENTS

| | | | | | |
|---|---|---|---|---|---|
| 1,156,074 | A | * | 10/1915 | Hahn | 206/594 |
| 4,329,068 | A | * | 5/1982 | Neuner et al. | 366/214 |
| 4,497,581 | A | | 2/1985 | Miller | |
| 4,788,438 | A | * | 11/1988 | Evers | 250/506.1 |
| 5,215,195 | A | * | 6/1993 | Williams | 206/446 |
| 5,322,358 | A | * | 6/1994 | Coho et al. | 366/214 |
| 5,383,163 | A | * | 1/1995 | Brunn | 366/217 |
| 5,399,013 | A | * | 3/1995 | Sawyer | 366/211 |
| 5,462,171 | A | * | 10/1995 | Moog et al. | 206/592 |
| 5,590,786 | A | * | 1/1997 | Jaycox | 206/587 |
| 6,364,150 | B1 | * | 4/2002 | Persinger | 220/735 |
| 6,709,148 | B2 | | 3/2004 | Glass | |
| 6,767,126 | B2 | | 7/2004 | Miller | |
| 6,945,690 | B2 | * | 9/2005 | Armendariz et al. | 366/209 |
| 6,960,012 | B1 | * | 11/2005 | Biber | 366/110 |

(Continued)

FOREIGN PATENT DOCUMENTS

WO WO 2006/006029 A1 1/2006

OTHER PUBLICATIONS

Drawing, "Slant Handle Bottle, One Gallon," Nampac Div. of B-Way Corp., Drawing No. T-10011-002-SF, Mar. 2006, 1 page.

Product Information datasheet, UNIVAL DMDC-6143 NT 7, High Density Polyethylene Resin, Dow Chemical Company, Midland, MI, Published Mar. 2004, 2 pgs.

(Continued)

*Primary Examiner* — Tony G Soohoo

(74) *Attorney, Agent, or Firm* — Mueting Raasch & Gebhardt, P.A.

(57) ABSTRACT

A holder and system for mixing a volume of material within a closed container in a mixing machine. Holders and systems in accordance with embodiments of the present invention may permit mixing of fluids in containers that are otherwise ill-suited for conventional mixing machines. The holder may include a receptacle or bucket into which a first insert or adapter is placed to receive and hold one end of the closed container. A second insert may also be inserted into the bucket to receive and hold a second end of the closed container. The bucket may include a tapered inner sidewall surface and one or both adapters may include side surfaces that generally conform to the sidewall surface.

30 Claims, 6 Drawing Sheets

U.S. PATENT DOCUMENTS

| | | | | |
|---|---|---|---|---|
| 6,988,824 | B2 | 1/2006 | Santospago et al. | |
| 7,077,560 | B2 | 7/2006 | Huckby et al. | |
| 7,165,879 | B2 | 1/2007 | Midas et al. | |
| 7,497,348 | B2 * | 3/2009 | Johnson et al. | 220/4.22 |
| 2004/0208083 | A1 | 10/2004 | Armendariz et al. | |
| 2006/0109739 | A1 | 5/2006 | Huckby | |

OTHER PUBLICATIONS

Exhibit A, *Harbil 5G Mixer and Tray*, publically available before Aug. 10, 2006, 3 pgs.

Drawing, "5 Gallon Low Beam Ring 90 Mil Pail," *Nampac*, Drawing No. P-0050G-090-LBR, 1 pgs.

* cited by examiner

SYSTEM FOR SECURING A CONTAINER WITHIN A MIXING MACHINE

TECHNICAL FIELD

The present invention relates generally to mixing of fluids and/or dispersions (e.g., paint, paint colorants) and, more particularly, to an adapter or holder system for securing a container, e.g., a non-symmetrically-shaped container, within a mixing machine.

BACKGROUND

Paint mixing machines are commonly used (by retailers and commercial sellers alike) to mix paint at the time of sale or otherwise prior to use. Adequate agitation of the paint is beneficial to ensure that individual paint components that may have settled are redistributed to form the desired homogenous paint mixture.

These mixing machines are available in a variety of styles. Regardless of style, however, the primary function of these machines is to securely hold a sealed, generally cylindrical paint can or bucket and impart a particular motion thereto, e.g., axial shaking, spinning, or orbital movement. Such motion agitates the container until the paint is adequately mixed.

Currently, many do-it-yourself (DIY) and professional painters rely on custom color matching at the time of sale to provide paints that have a specific color or other characteristic, e.g., texture. This color customization is typically achieved by adding one or more colorants or tinting agents to a neutral (e.g., white) paint base. These colorants are often provided as a concentrated mixture of solid pigment particles dispersed within a base fluid. Other components (e.g., surfactants) may also be included with the colorant.

Unlike paint, which is usually provided in conventional cylindrical cans (e.g., one gallon) or buckets (e.g., five gallon), concentrated colorants are often packaged in different containers. For example, many colorants are provided in plastic containers (e.g., quart or gallon size) that are non-circular (e.g., rectangular) in cross-section. These containers may incorporate a resealable pour spout and optionally a handle near a top end of the container. The colorant may be poured into an open paint can before the paint is mixed.

After packaging, the solid pigment in the colorant may settle towards the bottom of the container. As a result of this settling, the concentration of the pigment may not be equivalent throughout the volume, e.g., a higher concentration of pigment may be present near the bottom of the container. As one can appreciate, significant variation in pigment concentration may result in unintended coloring results.

In order to redistribute the pigment, the colorant may be mixed prior to use. Manual shaking of the container, while adequate, may be physically fatiguing and yield less than desirable results. Accordingly, it would be preferable to utilize an existing paint mixing machine to mix the colorant before use. However, conventional paint mixing machines are generally designed to accommodate standard, cylindrical (metallic) one gallon paint cans and/or five gallon cylindrical plastic buckets. Inserting a rectangular container into such a mixing machine (if even possible) may result in damage to the container and/or the mixing machine and/or poor mixing results.

SUMMARY

The present invention may overcome these and other issues with fluid mixing. For example, in one embodiment, a holder for mixing material enclosed within a container is provided. The holder may include: a bucket forming a receptacle, wherein the bucket has: a base; and an integral and tapered sidewall extending upwardly from the base to define an open top of the bucket. The holder may also include a base adapter operable to securely seat inside the bucket on an inner surface of the base, wherein an upper surface of the base adapter defines a recess sized to securely receive a first end of the fluid container. An upper adapter may also be provided and include: a body configured to locate inside the bucket and to securely seat relative to a tapered inner surface of the sidewall when the body is located proximate the open top; and an integral lid to cover the open top of the bucket, wherein a lower surface of the upper adapter defines a recess sized to securely receive a second end of the container.

In another embodiment, a holder for mixing material enclosed within a container is provided, wherein the holder includes a bucket forming a receptacle, the bucket comprising: a base; and an integral and tapered sidewall extending upwardly from the base to define an open top of the bucket. The holder may also include a base adapter having: a planar lower surface operable to seat flush on an inner surface of the base; an outer surface positionable proximate to, or in contact with, an inner surface of the sidewall when the lower surface is seated on the inner surface of the base; and an upper surface defining a recess sized to securely receive a first end of the container. An upper adapter may also be provided and include: a lid to cover the open top of the bucket; and a body extending from a lower side of the lid. The body may include an outer surface positionable proximate to, or in contact with, the inner surface of the sidewall of the bucket when the lid is proximate to, or in contact with, the bucket. A lower surface of the body defines a recess sized to securely receive a second end of the container.

In yet another embodiment, a holder system for mixing fluid is provided. The system includes: a resealable container for holding a volume of fluid; and a bucket forming a receptacle, the bucket having a base and an integral and tapered sidewall extending upwardly from the base to define an open top of the bucket. The system further includes a base adapter having: a planar lower surface operable to seat flush on an inner surface of the base; an outer surface positionable proximate to, or in contact with, an inner surface of the sidewall when the lower surface is seated on the inner surface of the base; and an upper surface defining a recess sized to securely receive a first end of the container. An upper adapter is also provided and includes: a lid to cover the open top of the bucket; and a body extending from a lower side of the lid. The body includes an outer surface positionable proximate to, or in contact with, the inner surface of the sidewall of the bucket when the lid is proximate to, or in contact with, the bucket. A lower surface of the body defines a recess sized to securely receive a second end of the container.

The above summary is not intended to describe each embodiment or every implementation of the present invention. Rather, a more complete understanding of the invention will become apparent and appreciated by reference to the following Detailed Description of Exemplary Embodiments and claims in view of the accompanying figures of the drawing.

BRIEF DESCRIPTION OF THE VIEWS OF THE DRAWING

The present invention will be further described with reference to the figures of the drawing, wherein:

FIGS. 2A and 2B illustrate a first capture device, e.g., a base adapter, for use with the system of FIG. 1, wherein: FIG. 2A is a side elevation view; and FIG. 2B is a top plan view;

FIGS. 3A-3C illustrate a second capture device, e.g., an upper adapter, for use with the system of FIG. 1, wherein: FIG. 3A is a side elevation view; FIG. 3B is a bottom plan view; and FIG. 3C is a lower perspective view;

FIGS. 4A-4B illustrate a fluid container in accordance with one embodiment of the invention for use with the holder system of FIG. 1, wherein: FIG. 4A is a front view; and FIG. 4B is a side view;

Figure 1:
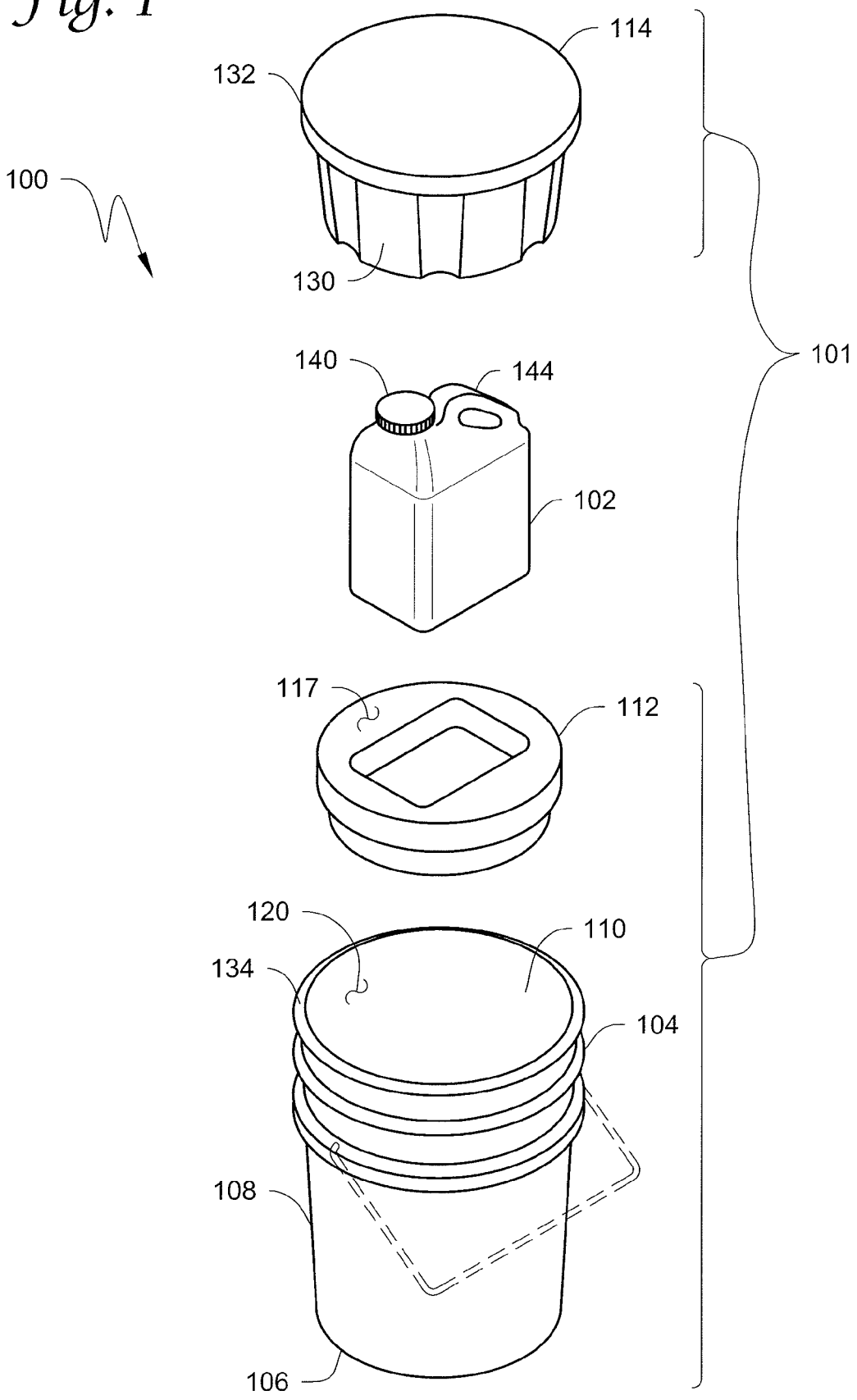
FIG. 1 is an exploded perspective view of a holder system for securing a container, e.g., non-cylindrical container, to a mixing machine in accordance with one exemplary embodiment of the invention.

The figures are rendered primarily for clarity and, as a result, are not necessarily drawn to scale.

DETAILED DESCRIPTION OF EXEMPLARY EMBODIMENTS

In the following detailed description of illustrative embodiments of the invention, reference is made to the accompanying figures of the drawing which form a part hereof, and in which are shown, by way of illustration, specific embodiments in which the invention may be practiced. It is to be understood that other embodiments may be utilized and structural changes may be made without departing from the scope of the present invention.

The present invention is directed to mixing of fluids and fluid-like substances and, more particularly, to holders and holder systems for mixing material enclosed within a container (e.g., a non-symmetrically-shaped container) utilizing a conventional paint mixing machine. Exemplary systems include a receptacle, e.g., a five gallon plastic bucket, which may be received within many of the paint mixing machines now in use. Holder systems in accordance with embodiments of the present invention may also be configured to handle containers of most any configuration including, for example, plastic containers having a non-circular, e.g., rectangular, cross section as shown in the Figures. Further benefits of systems in accordance with embodiments of the present invention will become apparent from the following description and figures.

It is noted that the terms "comprises" and variations thereof do not have a limiting meaning where these terms appear in the accompanying description and claims. Further, "a," "an," "the," "at least one," and "one or more" are used interchangeably herein.

Relative terms such as left, right, forward, rearward, top, bottom, side, upper, lower, above, below, horizontal, vertical, and the like may be used herein and, if so, are from the perspective observed in the particular figure, or as observed when using the system (see, e.g., FIGS. 1 and 5), unless otherwise stated herein. These terms are used only to simplify the description, however, and not to limit the scope of the invention in any way.

With reference to the drawings, wherein like reference numerals designate like parts and assemblies throughout the several views, FIG. 1 illustrates an exploded perspective view of a holder system 100 for mixing material, e.g., fluid, in accordance with one embodiment of the invention. As used herein, the term "fluid" may include not only fluids, but other fluid-like substances (e.g., powders) as well. For brevity, the fluid will be described herein in the context of paint colorants. However, those of skill in the art will recognize that other materials may be substituted for the colorants described herein without departing from the scope of the invention.

The system 100 may include a holder 101 operable to capture or otherwise suspend a resealable fluid container 102 holding a volume of fluid (e.g., paint colorant) therein. In the illustrated embodiment, the holder 101 includes a receptacle, which may be configured as a conventional plastic five gallon paint bucket 104 (all references herein to "gallon" are to U.S. gallons). As used herein, "five gallon paint bucket" refers to a generally cylindrically shaped receptacle that has a bottom or base 106 and at least one integral sidewall 108 extending upwardly from the base to define an open top 110. While described as cylindrical, the sidewall 108 of the bucket 104 may be slightly tapered, e.g., the sidewall may actually form a frusto-conical surface. The exact taper angle (draft) may be relatively small, e.g., zero to about 5 degrees. The taper angle is often greater than zero, e.g., 2 degrees or more, to assist with producibility and to permit stacking of the bucket.

In one embodiment, the bucket 104 is a model P-0050G-090-LBR pail distributed by the Nampac Division of BWAY Corp., of Atlanta, Ga., USA, having an interior volume of about five gallons. It may further have a minor diameter (e.g., measured at the outside of the bucket at the base 106) of about 10.44 inches, a major diameter (measured at the outside of the bucket at a lip 134 of the open top 110) of about 11.9 inches, and a height of about 14.56 inches. This yields a taper angle of about 2-3 degrees. The bucket may, in one embodiment, be made from high-density polyethylene (HDPE) or similar material having a wall thickness of about 0.09 inches. These dimensions and material are not limiting, however, as most any receptacle that is receivable within a conventional paint mixing machine is certainly possible without departing from the scope of the invention. The bucket 104 could optionally include a handle as represented in broken lines in FIG. 1.

The holder 101 may further include a first capture device, e.g., base insert or adapter 112, and a second capture device, e.g., upper insert or adapter 114. The base and upper adapters may include features as further described below that permit the adapters to receive and capture, e.g., immobilize, the container 102 within a volume defined by the bucket 104.

Figure 2A:
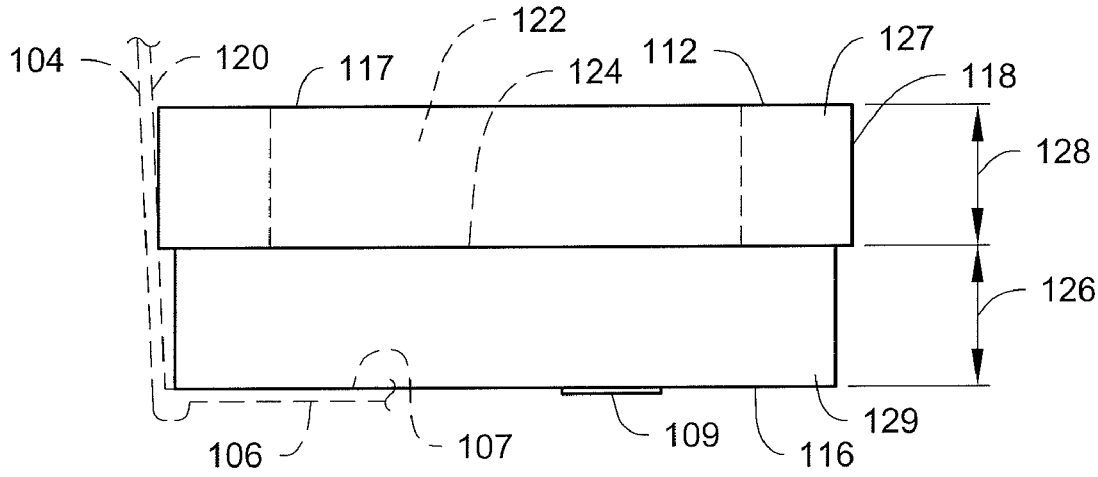
Figure 2B:
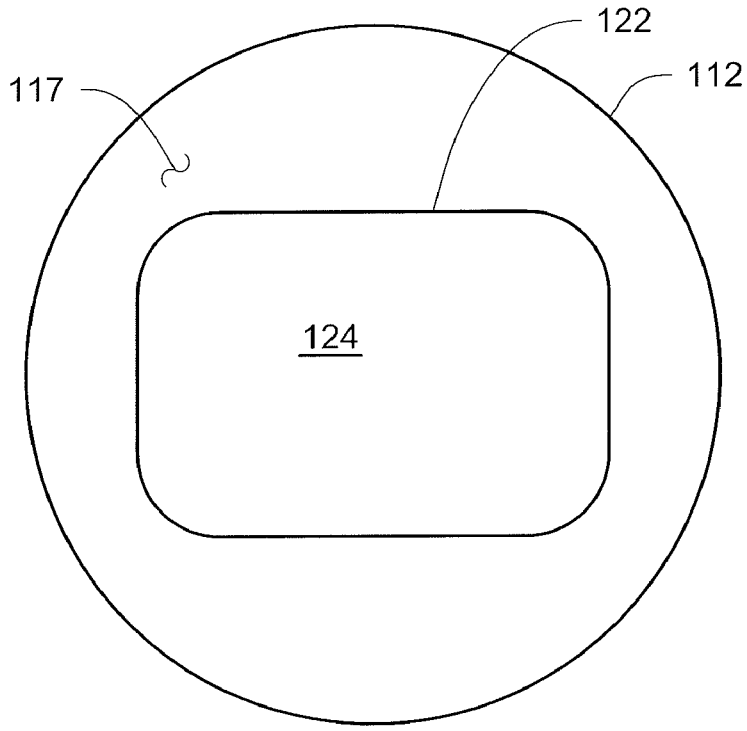

FIGS. 2A and 2B illustrate a side elevation view and top plan view, respectively, of the base adapter 112. In one embodiment, the base adapter may be made from plastic foam, e.g., polyethylene foam. The foam provides the base adapter with the ability to deform as the adapter is placed in the bucket and as the container is placed in the adapter. However, other materials—including for example, injection-molded polyurethane, acrylonitrile butadiene styrene (ABS) or HDPE—may be used without departing from the scope of the invention.

The base adapter 112 may be configured to fit through the open top 110 of the bucket 104 and securely seat flush on an inner surface 107 of the base 106 of the bucket as indicated in FIG. 2A. That is, the base adapter 112 may include a planar surface, e.g., a generally planar and circular lower surface 116, that is about the same diameter (or slightly smaller) as the inner surface 107 of the base 106 and is operable to rest upon the same. The base adapter 112 may further include an outer surface 118 that is proximate to, or in contact with (e.g., frictionally engages), an inner surface 120 of the sidewall when the lower surface 116 is seated on the inner surface 107 of the base 106. The outer surface 118 may, in one embodiment, be tapered (e.g., be frusto-conical in shape) to the same degree as an inner surface 120 of the sidewall 108. That is, the outer surface could have a peripheral shape that is substantially congruent with the shape of the inner surface of the sidewall 108.

Alternatively, as shown in the figures, the outer surface 118 may be stepped as further described below. The steps may be sized to provide minimal clearance (or, alternatively, some degree of interference) between the periphery of the base adapter and the sidewall as shown in FIG. 2A. As a result, a peripheral edge of the upper surface 117 may be proximate to, or in contact with, the inner surface 120 of the sidewall at most all points along the peripheral edge of the upper surface as indicated in FIG. 2A. Regardless of design, the base adapter may have a shape that permits it to seat within the bucket and be generally immobilized therein by the sidewall 108.

As used herein, the terms "securely seat," "securely received," and the like are used to indicate that two components, e.g., the base adapter and the bucket, are designed to fit together with very little or no clearance, e.g., a fit ranging from a slight clearance to a slight interference fit. To accommodate this fit, in some embodiments, one component may deform, deflect, or otherwise compress during assembly.

The base adapter 112 may further include an upper surface 117 that defines, or otherwise has formed therein, a recess 122 sized to securely receive a first, e.g., lower, end of the container 102. In one embodiment, the recess substantially conforms to the shape of (e.g., is generally congruent with) the lower end of the container 102 (see, e.g., FIG. 4). Alternatively, the recess could include various inwardly extending protrusions (not shown) that may secure or frictionally engage the container 102. As a result, the lower end of the container 102 may be securely received, e.g., with a slight clearance or interference fit, within the recess 122. In the illustrated embodiment, the upper surface 117 is generally parallel to the base 106, e.g., to the inner surface 107 of the base, of the bucket 104 when the system is assembled, e.g., when the container is held therein.

The recess 122 may further be defined by a floor 124 that supports a bottom surface of the container 102. The floor 124 may be offset from the inner surface 107 of the base 106 (when the lower surface 116 is seated on the inner surface of the base) by a distance 126 that, in the illustrated embodiment is about 2.13 inches. The location of the recess 122 and the distance 126 may be selected to locate the center of gravity (CG) of the container 102 in the desired location within the bucket 104. The recess may also have a depth 128 selected to provide adequate overlap with the container 102. In the illustrated embodiment, the depth 128 is also about 2.13 inches.

The adapter 112 may be produced in accordance with any acceptable method. For example, the adapter may be made of two separate portions 127 and 129 that are attached, e.g., by adhesive or heat weld. The upper portion 127 may have a die cut opening formed therein to define the recess 122, while the lower portion 128, which defines the floor 124, may be generally solid and cylindrical or disc-shaped. When the two portions are attached, the adapter 112 may be configured as shown in the figures. In other embodiments, the entire adapter may be die-cut from a single piece of material.

Figure 3A:
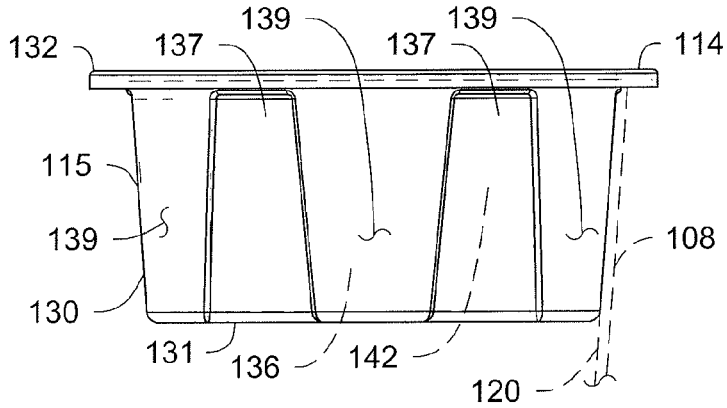
Figure 3B:
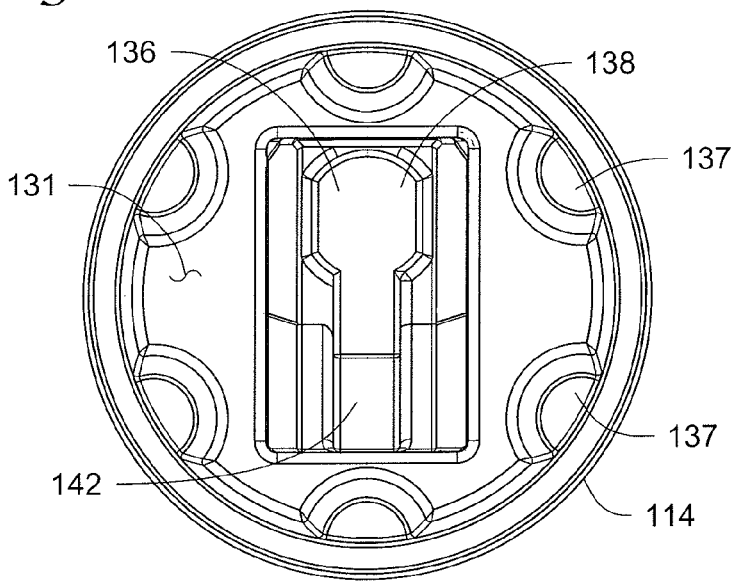
Figure 3C:
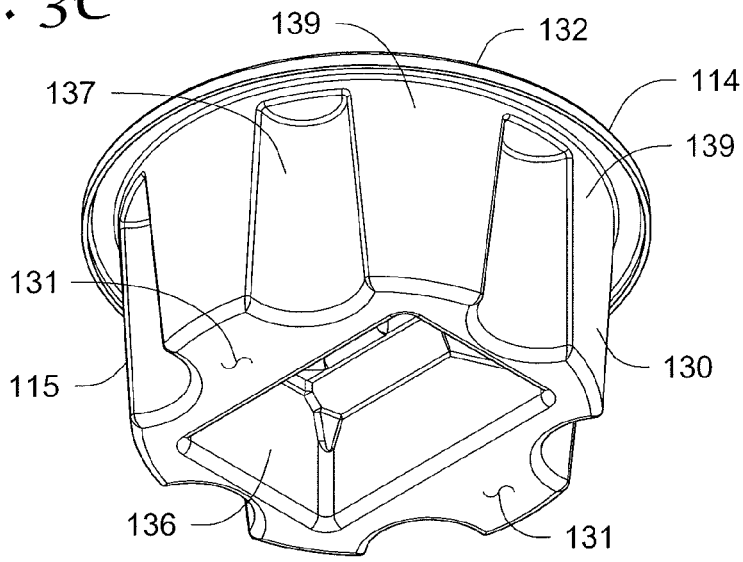

FIGS. 3A and 3B illustrate a side elevation view and bottom plan view, respectively, of the upper adapter 114, while FIG. 3C illustrated a lower perspective view. In one embodiment, the upper adapter could be made from a material similar or identical to that of the base adapter, e.g., a resilient material such as foam, and optionally including an additional wear-resistant layer for contacting the container 102. In the illustrated embodiment, the upper adapter may be made from injection molded HDPE (although other materials (e.g., ABS) may be used without departing from the scope of the invention). As a result, the base adapter 112 may include a first material and the upper adapter 114 may include a second material, wherein the first material has greater compliance than the second material such that the upper adapter is more rigid than the lower adapter. This rigidity provides the upper adapter with increased durability to resist wear damage from the more complex contacting surface shapes of the upper portion of the container 102. The more compliant base adapter 112 may provide various benefits, including, for example, absorption of shock loads.

The upper adapter 114 may include a body or body portion 115 configured to fit through the open top 110 of the bucket 104 and locate inside the bucket 104 proximate the open top. In this location, the body 115 of the upper adapter 114 may securely seat relative to, e.g., proximate to or in contact with, the tapered inner surface 120 of the sidewall 108. In one embodiment, this is achieved by providing the body 115 so that it includes an outer surface 130 that generally corresponds in size and shape to (e.g., is congruent with) the tapered inner surface 120 proximate the open top. For example, the outer surface 130 may be tapered (e.g., be frusto-conical in shape) to the same degree as the inner surface 120 of the sidewall 108. Moreover, the outer surface 130 may be sized to correspond to the diameter sizes of the inner surface 120 of the sidewall at the desired elevations. As a result, the upper adapter 114 may seat within the bucket and be substantially immobilized therein by the sidewall 108.

Figure 5:
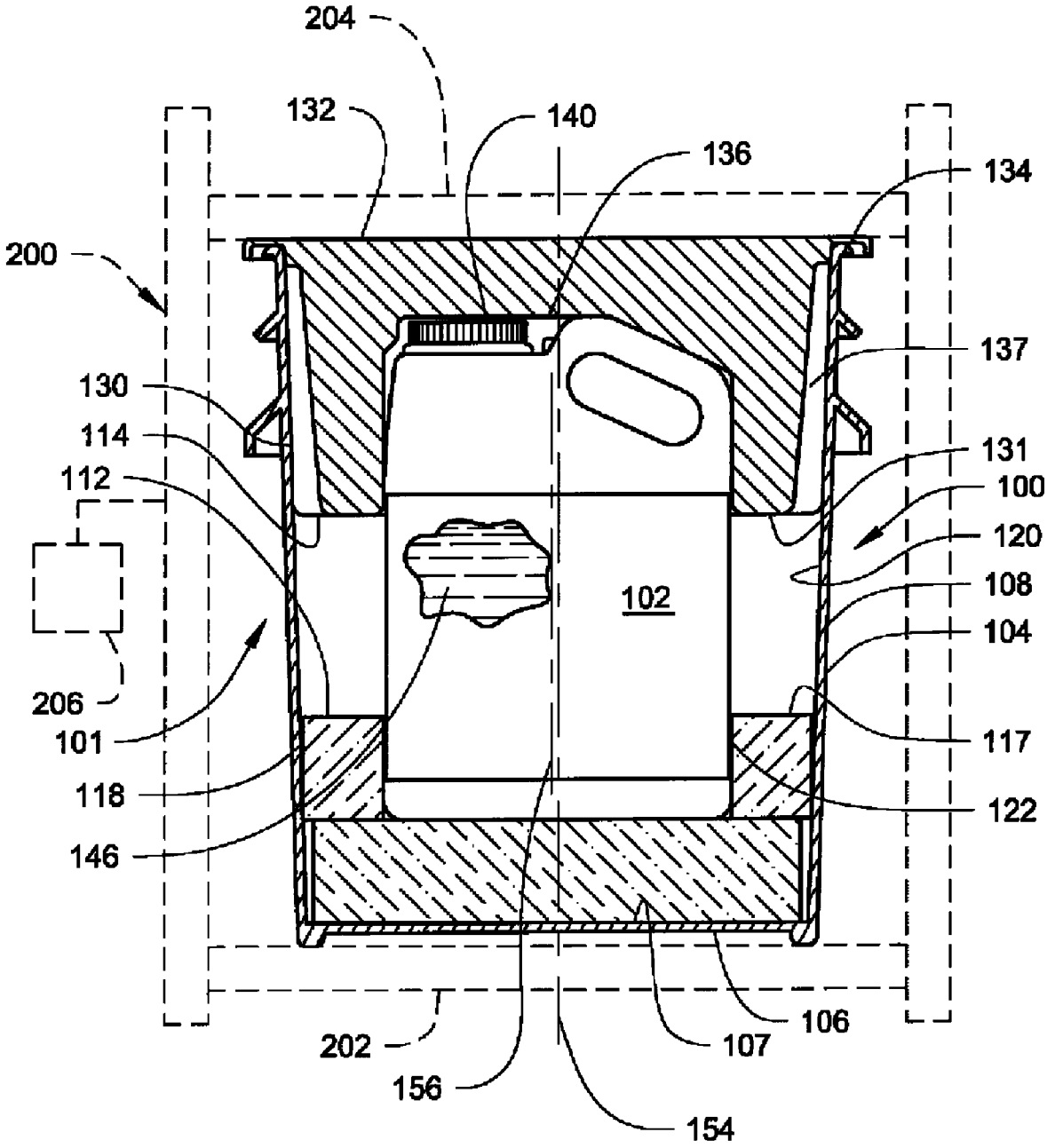
FIG. 5 is a diagrammatic section view of the holder system of FIG. 1 as assembled and located within a mixing machine.

The holder, e.g., upper adapter 114, may also include a lid or lid portion 132 operable to cover the open top 110 of the bucket 104 during mixing. The lid may, as shown in the illustrated embodiment, be integrally formed with the body 115, e.g., the body may extend from a lower side of the lid. The lid may be configured as a disk shaped portion or member that seats near or against the upper lip 134 of the bucket 104 when the outer surface 130 of the body 115 seats against the inner surface 120 of the sidewall 108 as shown in FIG. 5. For example, the outer surface 130 may be configured to abut or frictionally engage the inner surface 120 (as described above) when the lid is proximate to, or in contact with, the top of the bucket 104. As stated above, the material of the base adapter 112 may be selected to permit slight deflection or deformation to ensure that the lid 132 may evenly contact the lip 134 during operation.

Like the base adapter 112, the upper adapter 114 may have a lower surface 131 that defines, or otherwise has formed therein, a recess 136. However, the recess 136 is sized to securely receive a second, e.g., top, end of the container 102 (see FIG. 5). As a result, the recess may have a shape configured to substantially conform to the shape of (e.g., be congruent with or provide slight clearance to slight interference with), the upper end of the container 102 (see, e.g., FIG. 5). For example, the recess 136 may include a cylindrical depression or portion 138 to receive a removable cap 140 (see FIGS. 1 and 4A-4B) of the container 102, as well as a sloped surface 142 to accommodate a slanted handle 144. Regardless of the specific configuration, the upper end of the container 102 is received within the recess 136. As with the upper surface 117 of the base adapter 112, the lower surface 131 of the upper adapter 114 may also be generally parallel to the base, e.g., to the inner surface 107 of the base, of the bucket 104 when the system is correctly assembled with the container 102 (see, e.g., FIG. 5).

In the illustrated embodiment, the outer surface 130 of the upper adapter 114 may form at least one discontinuous contact surface 139 that defines one or more longitudinal channels 137. The contact surface 139 may form the portion of the outer surface 130 that is congruent with, or otherwise engages, portions of the inner surface 120 of the sidewall 108. The channels 137 may provide the adapter 114 with an added degree of rigidity and further assist with reducing the potential for friction lock of the adapter within the bucket.

As stated above, the base adapter 112 and upper adapter 114 could be made from a common material, e.g., ABS or HDPE. The base adapter could, in this instance, have features analogous to the upper adapter (e.g., frusto-conical sidewalls, etc.) as described herein.

Figure 4A:
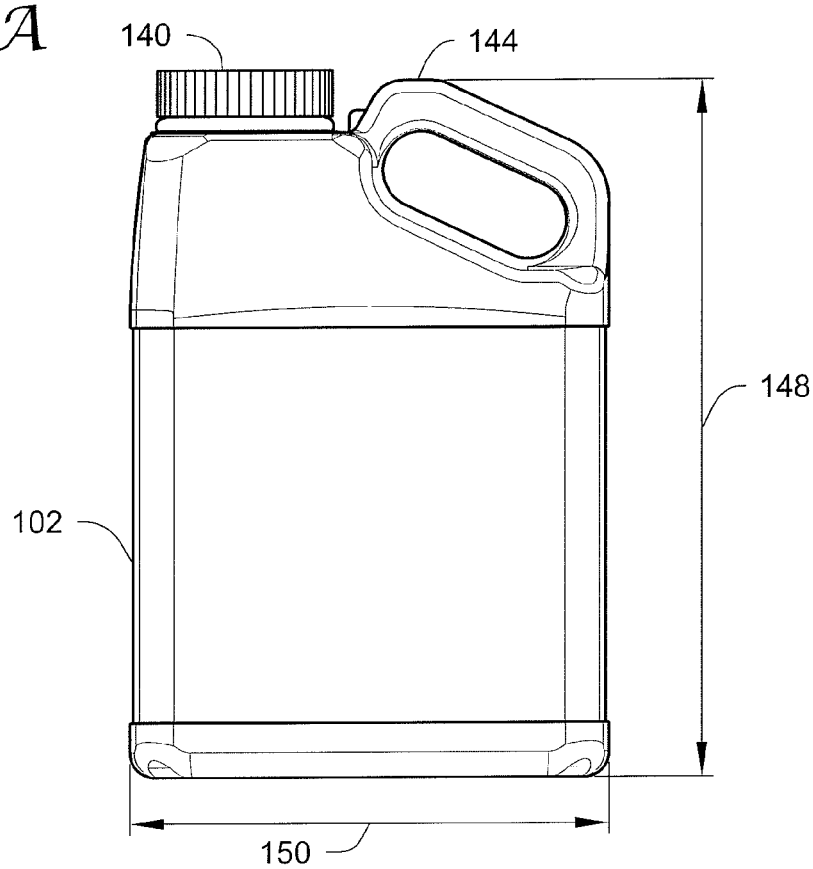
Figure 4B:
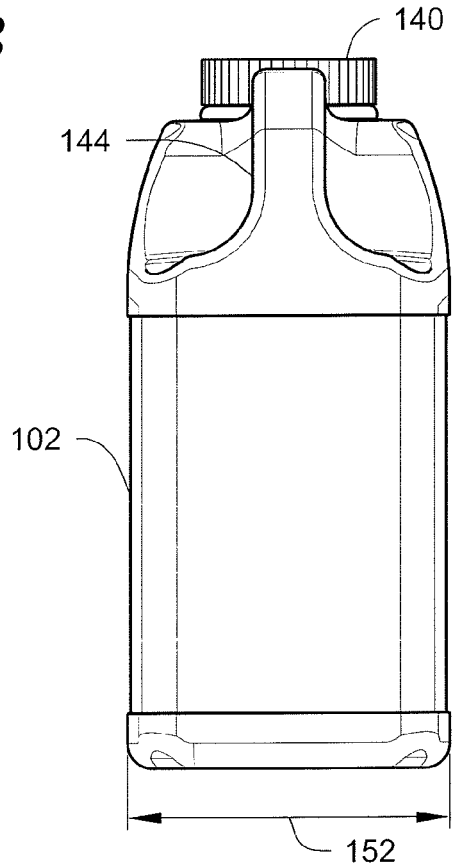

FIGS. 4A and 4B illustrate a front and side elevation view, respectively, of the exemplary container 102. The container 102 may have a relatively featureless (e.g., smooth) bottom surface that is received in the base adapter. An upper portion of the container 102 may include the opening with resealable cap 140 and the sloped handle 144. In one embodiment, the container is made of plastic, e.g., HDPE, and has an interior volume of about one gallon. It may have a height 148 of about 10.16 inches, a width 150 of about 7.06 inches, and a depth 152 of about 4.75 inches (dimensions when empty). However, other embodiments may utilize containers of different sizes, shapes, and materials without departing from the scope of the invention.

The recess 136 may have a depth that is configured to ensure adequate engagement with the top of the container 102 when the outer surface 130 of the upper adapter is at the desired elevation within the bucket 104, e.g., when the outer surface 130 is proximate to or in contact with the inner surface 120 of the sidewall 108 and the lid 132 is near or contacts the lip 134.

FIG. 5 illustrates the holder system 100 in section as the system may be configured during use with a mixing machine 200 (the latter shown diagrammatically). In use, the base adapter 112 may be placed within the bucket 104 until it seats along the inner surface of the base 106. In some embodiments, the lower surface 116 (see FIG. 2A) of the base adapter 112 may be adhered to the inner surface 107 of the base 106 of the bucket 104 with an adhesive layer 109 (see FIG. 2A) to further secure the base adapter.

The container 102 of colorant, with its cap 140 tightly installed, may then be placed such that its lower end fits securely within the recess 122 of the base adapter 112. The upper adapter 114 may then be placed over the open top 110 of the bucket 104 and oriented such that the recess 136 aligns with the top end of the container 102. The upper adapter 114 may then be pushed downwardly until the body 115 enters the bucket 104 and the top end of the container 102 is securely received within the recess 136. The upper adapter 114 may, in some embodiments, deform slightly to permit reception of the container with a slight interference fit. When the container 102 is fully inserted into the upper adapter 114, the outer surface 130 (as well as the outer surface 118 of the base adapter 112) may be very near or in contact with (e.g., frictionally engaged with) the inner surface 120 of the sidewall 108 as shown in FIG. 5. Moreover, the lid 132 may be close to, or rest against, the lip 134 of the bucket 104. As a result, the container 102 is firmly held in place relative to the bucket 104.

In the illustrated embodiment, the upper adapter 114 may further enclose the receptacle, e.g., enclose the container 102 within the volume defined by the adapters and the bucket, in case of a potential leak from the container. Moreover, the upper adapter 114 and base adapter 112 may be configured to secure the container such that a longitudinal axis 156 of the container 102 is generally parallel to, or coaxial with, a longitudinal axis 154 of the bucket 104.

The bucket 104 may then be placed within the mixing machine 200, e.g., between parallel shaker plates 202 and 204. A power source, e.g., electric motor 206 may then be activated to agitate the holder system 100. As the holder 101 is capable of generally fixing the container 102 relative to the bucket 104, agitation of the colorant within the container 102 may result. At the completion of the process, the bucket may be removed from the machine 200 and the container 102 removed from the bucket 104. The pigment is then preferably evenly distributed, within the material (e.g., colorant fluid 146), throughout the container volume, thus providing potentially more predictable coloring results.

Figure 6B:
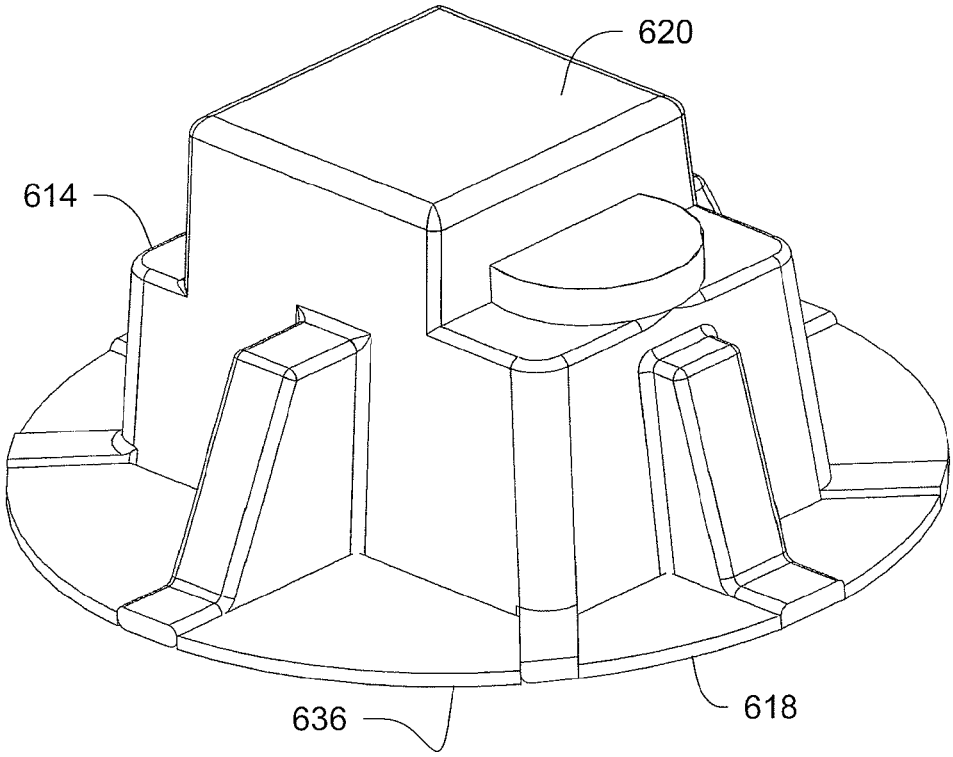
FIGS. 6A-6B illustrate perspective views of a base adapter and upper adapter, respectively, in accordance with another embodiment of the invention.
Figure 6A:
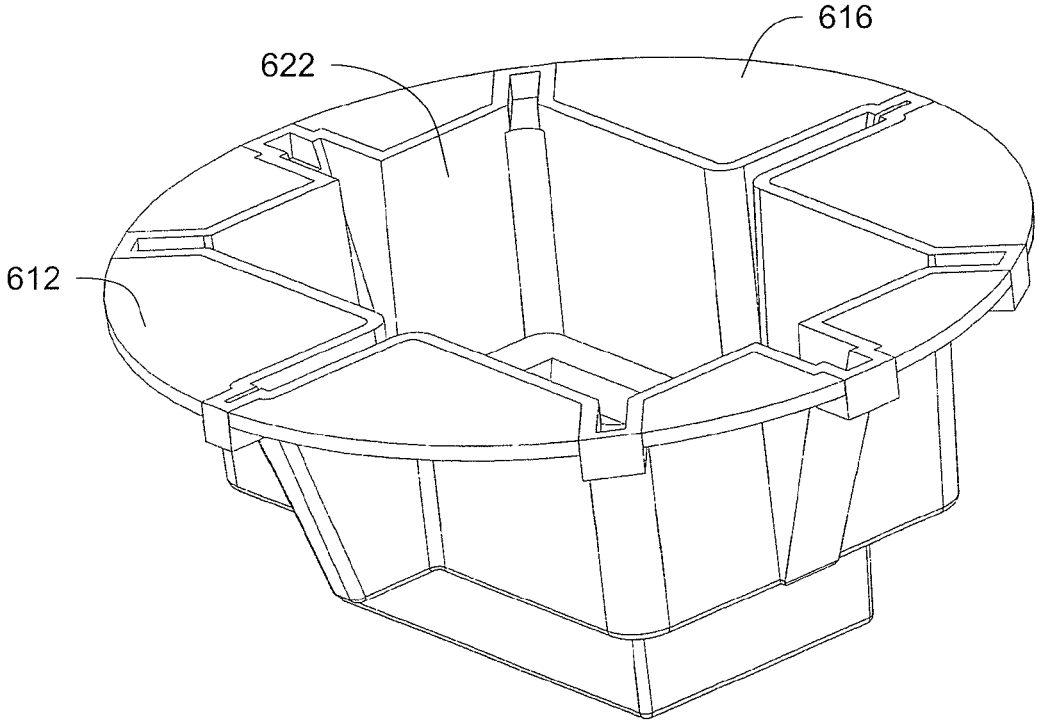

FIGS. 6A and 6B illustrate a base adapter 612 and upper adapter 614, respectively, in accordance with another embodiment of the invention. The adapters 612 and 614 may function in a manner similar to that described above with reference to the adapters 112 and 114, e.g., they may immobilize the container 102 within the bucket 104. As with the adapters 112 and 114, the base adapter 612 and upper adapter 614 could be made from a common material (e.g., ABS or HDPE) or, alternatively, dissimilar materials. The adapters 612 and 614 may define recesses, e.g., recesses 622 and 636, to receive the corresponding ends of the container (not shown) in a manner similar to that already described herein. However, unlike the adapters 112 and 114, the adapters 612 and 614 (e.g., the recesses 622 and 636) may be sufficiently deep such that the adapters contact one another, e.g., at contacting flanges 616 and 618, when fully assembled with the container. As a result, the adapters may generally enclose the container 102 during use. While not illustrated, the upper adapter 614 may include an integral lid similar to that of the upper adapter 114. Alternatively, the surface 620 may extend above the lip of the bucket to provide a contact surface for the mixing machine.

The holder and systems described herein may thus permit the mixing of materials contained within containers that are not otherwise well-suited to mounting in standard paint mixing systems. While described herein in the context of paint colorants, such an application is not limiting as other embodiments may be directed to most any other fluid dispersion or suspension that benefits from agitation.

Illustrative embodiments of this invention are discussed and reference has been made to possible variations within the scope of this invention. These and other variations, combinations, and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A holder for mixing material enclosed within a container, the holder comprising:

a bucket forming a receptacle, the bucket comprising: a base; and an integral and tapered sidewall extending upwardly from the base to define an open top of the bucket;

a base adapter operable to securely seat inside the bucket on an inner surface of the base, wherein an upper surface of the base adapter defines a recess sized to securely receive a first end of the container; and an upper adapter comprising: a body configured to locate inside the bucket and to securely seat relative to a tapered inner surface of the sidewall when the body is located proximate the open top; and an integral lid to cover the open top of the bucket, the body extending from a lower side of the lid, wherein a lower surface of the upper adapter defines a recess sized to securely receive a second end of the container, the recess of the upper adapter defined by one or more downwardly facing surfaces.

2. The holder of claim 1, wherein the base adapter comprises a generally planar and circular lower surface.

3. The holder of claim 2, wherein the circular lower surface is adhered to the inner surface of the base.

4. The holder of claim 1, wherein the body of the upper adapter comprises an outer surface that corresponds in size and shape to the tapered inner surface of the sidewall when the body is located proximate the open top.

5. The holder of claim 4, wherein the outer surface defines one or more longitudinal channels.

6. The holder of claim 1, wherein the upper adapter encloses the receptacle.

7. The holder of claim 1, wherein the base adapter comprises a first material and the upper adapter comprises a second material, the first material having greater compliance than the second material.

8. The holder of claim 7, wherein the base adapter comprises polyethylene foam.

9. A holder for mixing material enclosed within a container, the holder comprising:

a bucket forming a receptacle, the bucket comprising: a base; and an integral and tapered sidewall extending upwardly from the base to define an open top of the bucket;

a base adapter comprising: a planar lower surface operable to seat flush on an inner surface of the base; an outer surface positionable proximate to, or in contact with, an inner surface of the sidewall when the lower surface is seated on the inner surface of the base; and an upper surface defining a recess sized to securely receive a first end of the container; and an upper adapter comprising: an integral lid to cover the open top of the bucket; and a body extending from a lower side of the lid, the body comprising an outer surface positionable proximate to, or in contact with, the inner surface of the sidewall of the bucket when the lid is proximate to, or in contact with, the bucket; wherein a lower surface of the body defines a recess sized to securely receive a second end of the container, and wherein the lid is, when the upper adapter is inserted into the bucket, configured to enclose an interior volume defined by the bucket.

10. The holder of claim 9, wherein the upper surface of the base adapter is generally parallel to the base of the bucket.

11. The holder of claim 9, wherein the lower surface of the upper adapter is generally parallel to the base of the bucket.

12. The holder of claim 9, wherein a peripheral edge of the upper surface of the base adapter is proximate to, or in contact with, the inner surface of the sidewall at most all points along the peripheral edge.

13. The holder of claim 9, wherein the upper adapter comprises a material selected from the group consisting of acrylonitrile butadiene styrene and high-density polyethylene.

14. The holder of claim 9, wherein the base adapter comprises polyethylene foam.

15. The holder of claim 9, wherein the recess formed in the upper surface of the base adapter generally conforms to the first end of the container.

16. The holder of claim 9, wherein the recess fo wed in the lower surface of the upper adapter receives the second end of the container with an interference fit.

17. The holder of claim 9, further comprising an adhesive layer located between the lower surface of the base adapter and the inner surface of the base.

18. A holder system for mixing fluid, the system comprising: a resealable container for holding a volume of fluid;

a bucket forming a receptacle, the bucket comprising a base and an integral and tapered sidewall extending upwardly from the base to define an open top of the bucket;

a base adapter comprising: a planar lower surface operable to seat flush on an inner surface of the base; an outer surface positionable proximate to, or in contact with, an inner surface of the sidewall when the lower surface is seated on the inner surface of the base; and an upper surface defining a recess sized to securely receive a first end of the container; and an upper adapter comprising: a lid to cover the open top of the bucket; and a body extending from, and integral with, a lower side of the lid, the body comprising an outer surface positionable proximate to, or in contact with, the inner surface of the sidewall of the bucket when the lid is proximate to, or in contact with, the bucket; wherein a lower surface of the body defines a recess sized to securely receive a second end of the container, the recess of the upper adapter defined by one or more surfaces configured to contact upwardly facing surfaces of the container.

19. The system of claim 18, wherein the container is defined by a non-circular cross section.

20. The system of claim 19, wherein the non-circular cross section comprises a rectangular cross section.

21. The system of claim 18, wherein the recess of the base adapter is further defined by a floor that is offset from the inner surface of the base when the lower surface of the base adapter is seated on the inner surface of the base.

22. The system of claim 18, wherein the second end of the container comprises a removable cap and a slanted handle.

23. The system of claim 22, wherein the recess formed in the lower surface of the upper adapter has a shape that corresponds to the removable cap and slanted handle.

24. The system of claim 18, wherein the outer surface of the body of the upper adapter comprises one or more contact surfaces that are congruent with portions of the inner surface of the sidewall proximate the open top.

25. The system of claim 18, wherein the base adapter comprises polyethylene foam.

26. The system of claim 18, wherein the upper adapter comprises a material selected from the group consisting of acrylonitrile butadiene styrene and high-density polyethylene.

27. The system of claim 18, wherein the bucket defines an interior volume of about five gallons or more.

28. The system of claim 18, wherein the container defines an interior volume of about one gallon.

29. The system of claim 18, wherein the container comprises plastic.

30. The system of claim 18, wherein the upper adapter and base adapter are configured to secure the container such that a longitudinal axis of the container is parallel to a longitudinal axis of the bucket.

* * * * *

UNITED STATES PATENT AND TRADEMARK OFFICE

CERTIFICATE OF CORRECTION

PATENT NO. : 7,959,345 B2
APPLICATION NO. : 11/891672
DATED : June 14, 2011
INVENTOR(S) : Wilken Benjamin, II It is certified that error appears in the above-identified patent and that said Letters Patent is hereby corrected as shown below:

Column 9, Line 59 (Claim 16)
Delete "fo wed" and insert --formed--

Signed and Sealed this
Ninth Day of August, 2011

David J. Kappos

David J. Kappos
*Director of the United States Patent and Trademark Office*